US006820825B1

(12) United States Patent
Wang

(10) Patent No.: US 6,820,825 B1
(45) Date of Patent: Nov. 23, 2004

(54) LAWN SPRINKLER NOZZLE PROVIDED WITH MEANS TO ADJUST SPRAY ANGLE THEREOF

(76) Inventor: Hsin-Fa Wang, No. 68, Mou Tan Lane, Lu Kang Town, Chang Hua Hsien (TW)

( * ) Notice: Subject to any disclaimer, the term of this patent is extended or adjusted under 35 U.S.C. 154(b) by 0 days.

(21) Appl. No.: 10/677,557

(22) Filed: Oct. 3, 2003

(51) Int. Cl.[7] ..... B05B 1/32

(52) U.S. Cl. ..... 239/457; 239/460; 239/511; 239/513; 239/514; 239/581.2; 239/DIG. 1

(58) Field of Search ..... 239/456, 460, 239/505, 511, 512, 513, 200, 581.1, 581.2, 202, 457, 514, DIG. 1

(56) References Cited

U.S. PATENT DOCUMENTS 4,579,285 A * 4/1986 Hunter ..... 239/457
5,642,861 A * 7/1997 Ogi et al. ..... 239/568
6,637,672 B2 * 10/2003 Cordua ..... 239/457

* cited by examiner

*Primary Examiner*—Dinh Q. Nguyen
(74) *Attorney, Agent, or Firm*—Alan D. Kamrath; Nikolai & Mersereau, P.A.

(57) ABSTRACT

A lawn sprinkler comprises a connection pipe, and a spray angle adjustment structure mounted at one end of the connection pipe and formed of a circular distribution member, an adjustment member and a control member. The control member is actuated to turn by the adjustment member such that one or more of a series of arcuate rims of the control member block one or more of a series of arcuate through holes of the circular distribution member, thereby resulting in the sprinkling of water in various patterns.

1 Claim, 7 Drawing Sheets

LAWN SPRINKLER NOZZLE PROVIDED WITH MEANS TO ADJUST SPRAY ANGLE THEREOF

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a lawn sprinkler nozzle, and more particularly to a lawn sprinkler nozzle comprising a spray-angle adjustment structure.

BACKGROUND OF THE INVENTION

The conventional lawn sprinkler nozzle is generally provided with a structure enabling the nozzle to spray in various patterns at a fixed angle. Such conventional lawn sprinkler nozzle as described above is therefore limited in function in that it is incapable of cost-effective irrigation in terms of water consumption.

BRIEF SUMMARY OF THE INVENTION

The primary objective of the present invention is to provide a lawn sprinkler nozzle capable of various spray-angle adjustments.

In keeping with the principle of the present invention, the foregoing objective of the present invention is attained by a lawn sprinkler comprising a connection pipe and a spray-angle adjustment structure mounted at one end of the connection pipe which is connected at the other end to a water supply source. The spray-angle adjustment structure comprises a circular distribution member, a control member, and an adjustment member. The circular distribution member is fixedly fastened in the one end of the connection pipe and is provided with a series of arcuate through holes which are concentric and different in distance from the circular center of the circular distribution member. The circular distribution member is located between the control member and the adjustment member. The control member is located beneath the circular distribution member and is provided with a series of arcuate rims. The control member is actuated by the adjustment member to turn in such a way that a specific arcuate through hole of the circular distribution member is blocked by a specific arcuate rim of the control member, thereby resulting in a specific spray angle.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
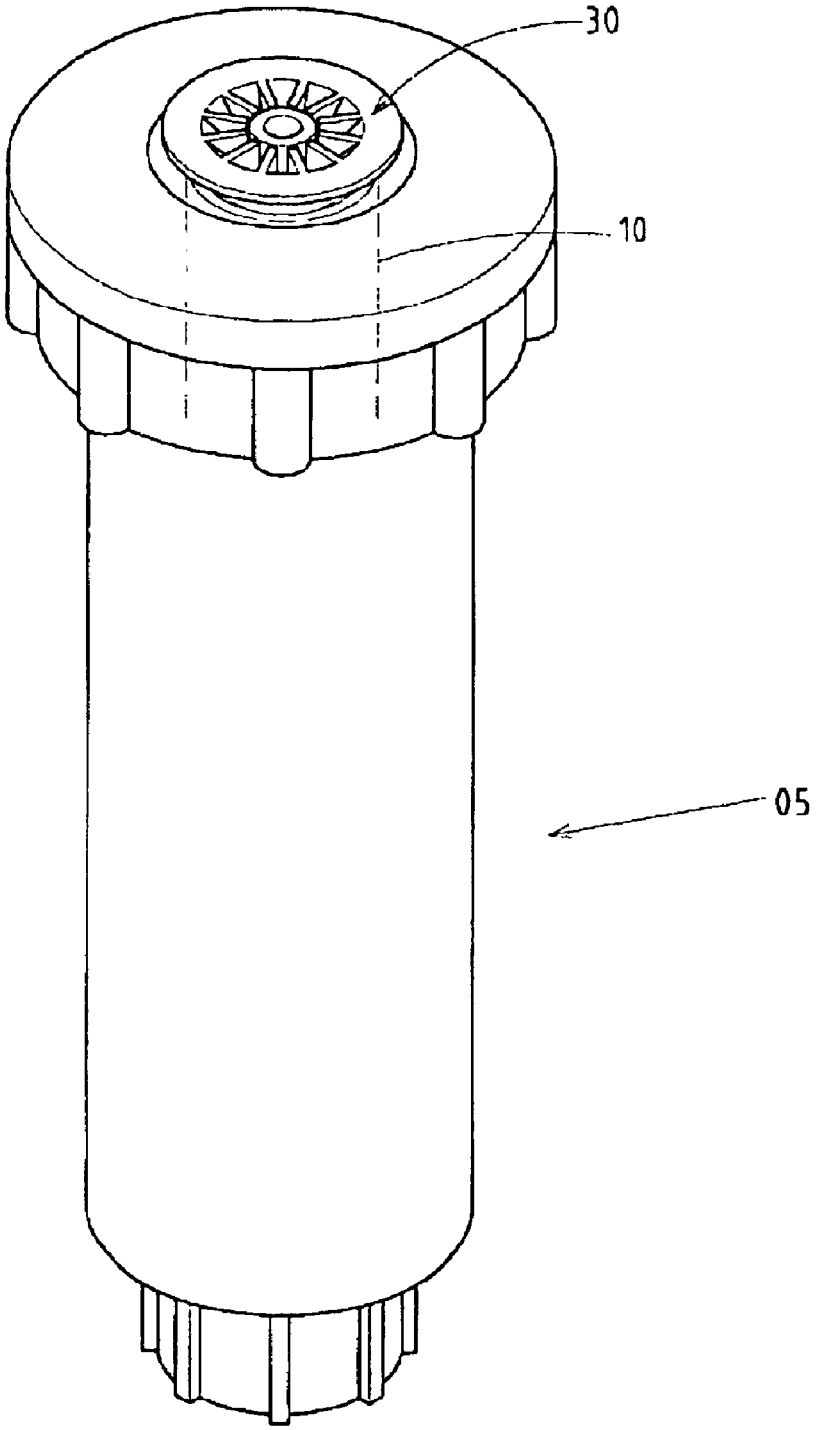
FIG. 1 shows a perspective view of the preferred embodiment of the present invention.
Figure 2:
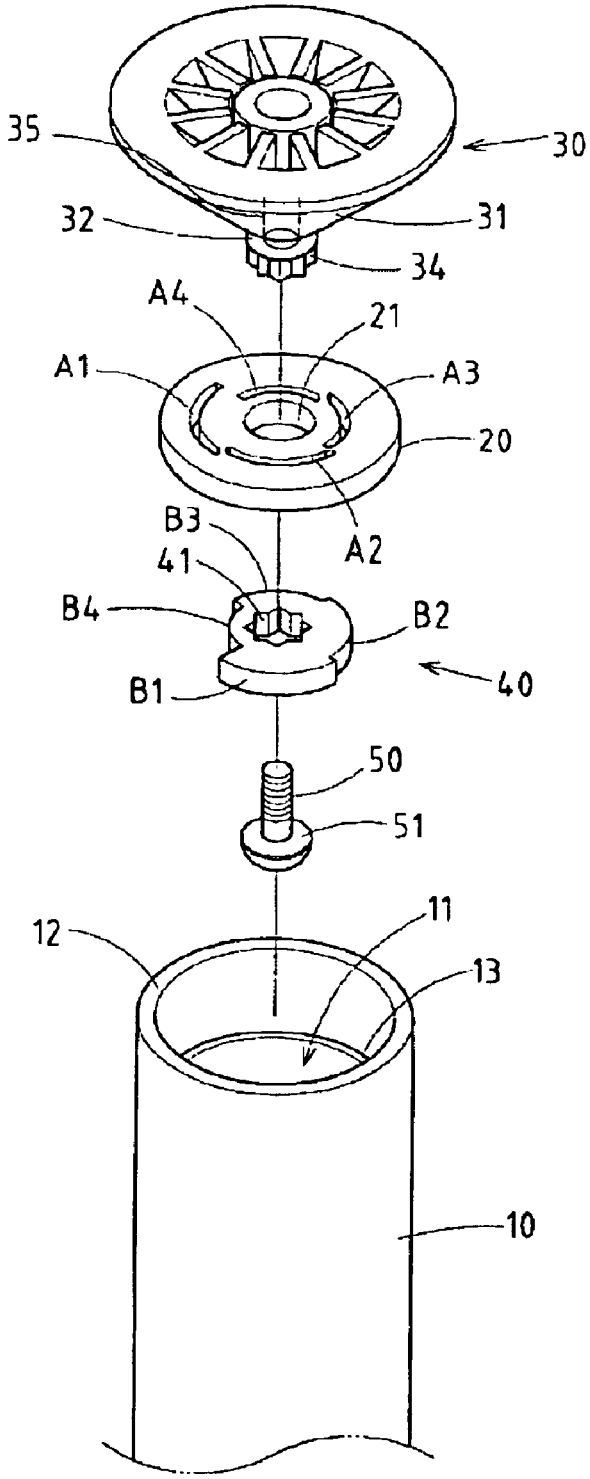
FIG. 2 shows an exploded view of the preferred embodiment of the present invention.
Figure 3:
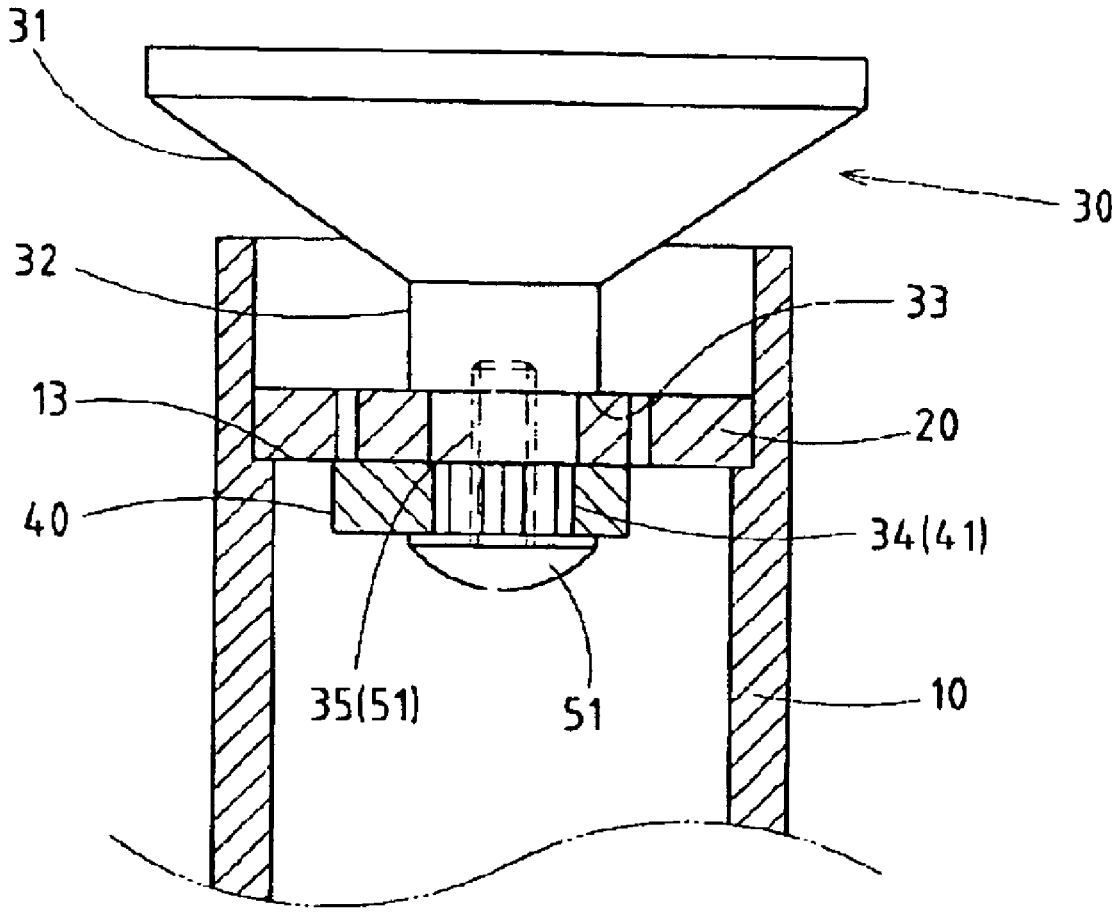
FIG. 3 shows a longitudinal sectional view of the preferred embodiment of the present invention in combination.

As shown in FIGS. 1–3, a pop-up sprinkler 05 embodied in the present invention comprises a connection pipe 10, and a spray-angle adjustment structure comprising a circular distribution member 20, an adjustment member 30, and a control member 40.

The spray-angle adjustment structure is mounted at a top end 12 of the connection pipe 10 which is connected at a bottom end to a water source.

The connection pipe 10 is provided in the top end 12 with an output port 11 having a shoulder 13 extending along the inner wall of the output port 11.

Figure 4:
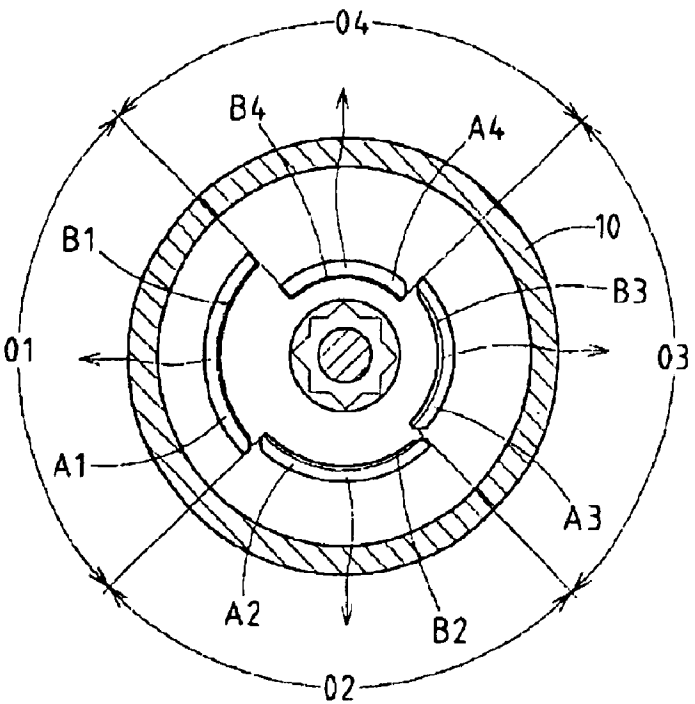
FIG. 4 is a sectional schematic view showing that the corresponding arcuate rims and arcuate through holes of the preferred embodiment of the present invention are arrangement correspondingly.

The circular distribution member 20 is fixedly located in the output port 11 such that the circular distribution member 20 is supported by the shoulder 13. The circular distribution member 20 is provided with a center through hole 21 and four arcuate through holes A1, A2, A3, and A4, which are concentric and different in distance from the center of the center through hole 21. The first arcuate through hole A1 is located in a first quadrant 01 (0°–90°). The second arcuate through hole A2 is located in a second quadrant 02 (90°–180°). The third arcuate through hole A3 is located in a third quadrant 03 (180°–270°). The fourth arcuate through hole A4 is located in a fourth quadrant 04 (270°–360°), as shown in FIG. 4. These four arcuate through holes A1, A2, A3, and A4 are progressively different in distance from the center of the center through hole 21 of the circular distribution member 20, with the first arcuate through hole A1 being the farthest as shown in FIG. 4.

The adjustment member 30 has a tapered portion 31 and a projection 32 extending from the free end of the tapered portion 31. The projection 32 is provided in the outer wall with a stop edge 33 and is further provided with a fastening segment 34 which is in turn provided with a threaded hole 35 engageable with the threads 50 of a fastening bolt 51. The adjustment member 30 is mounted on the circular distribution member 20 such that the projection 32 is put through the center through hole 21 of the circular distribution member 20.

The control member 40 is provided in the center with a through hole 41 and is further provided with a first arcuate rim B1, a second arcuate rim B2, a third arcuate rim B3, and a fourth arcuate rim B4, which are respectively corresponding to the first arcuate through hole A1, the second arcuate through hole A2, the third arcuate through hole A3, and the fourth arcuate through hole A4 of the circular distribution member 20. The control member 40 is mounted beneath the circular distribution member 20 such that the control member 40 is linked with the adjustment member 30 by the fastening bolt 51 which is engaged with the threaded hole 35 of the adjustment member 30. As a result, the control member 40 is actuated to turn by the adjustment member 30 in motion.

Figure 5:
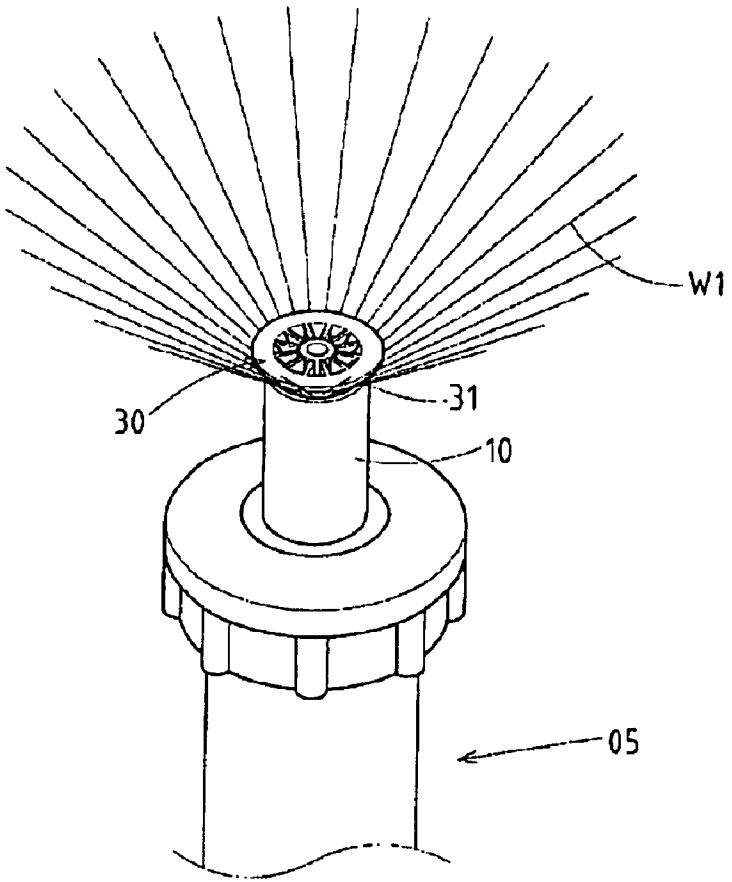
FIG. 5 shows a schematic view of a 360-degree spray pattern which is attained as a result of the arrangement as shown in FIG. 4.

As illustrated in FIGS. 4 and 5, a 360-degree spray pattern W1 is resulted from an arrangement in which the four arcuate through holes A1–A4 of the circular distribution member 20 are respectively corresponding in location to the four arcuate rims B1–B4 of the control member 40.

Figure 7:
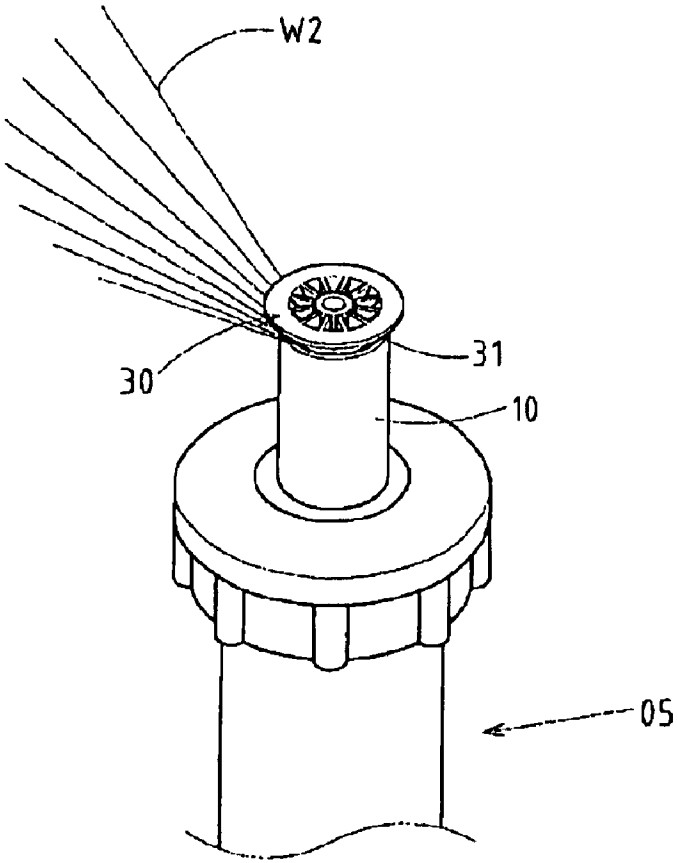
FIG. 7 shows a schematic view of a 90-degree spray pattern which is attained as a result of the arrangement as shown in FIG. 6.
Figure 6:
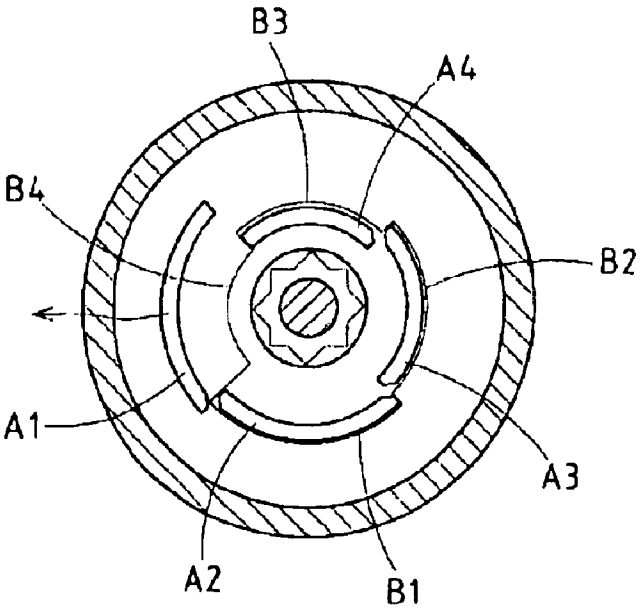
FIG. 6 shows a sectional schematic view of an arrangement of the arcuate rims and the arcuate through holes in the wake of a 90-degree rotation of the adjustment member of the present invention.

As illustrated in FIGS. 6 and 7, the adjustment member 30 is turned an angle of 90 degrees, thereby resulting in obstruction of the second arcuate through hole A2, the third arcuate through hole A3 and the fourth arcuate through hole A4 respectively by the first arcuate rim B1, the second arcuate rim B2, and the third arcuate rim B3. In another words, the passage of water is possible only through the first arcuate through hole A1 which cannot be blocked by the fourth arcuate rim B4, as illustrated in FIG. 6. In light of the 90-degree rotation of the adjustment member 30, a 90-degree spray pattern W2 is attained, as shown in FIG. 7.

Figure 9:
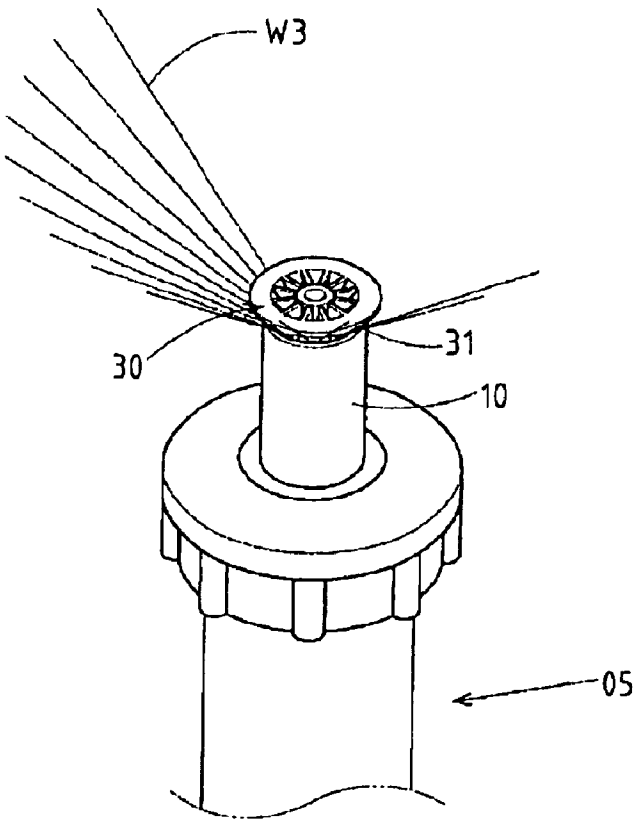
FIG. 9 shows a schematic view of a 180-degree spray pattern which is attained as a result of the arrangement as shown in FIG. 8.
Figure 8:
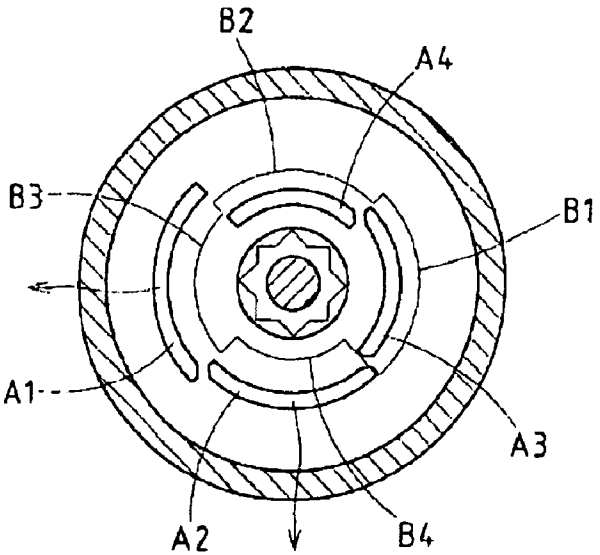
FIG. 8 shows a sectional schematic view of an arrangement of the arcuate rims and the arcuate through holes in the wake of a 180-degree rotation of the adjustment member of the present invention.

As shown in FIGS. 8 and 9, the adjustment member 30 is turned an angle of 180 degrees, thereby resulting in a similar rotation of the control member 40. As a result, the passage of water is allowed only through the first arcuate through hole A1 and the second arcuate through hole A2, as illustrated in FIG. 8. In light of the 180-degree rotation of the adjustment member 30, a 180-degree spray pattern W3 is formed, as shown in FIG. 9.

Figure 11:
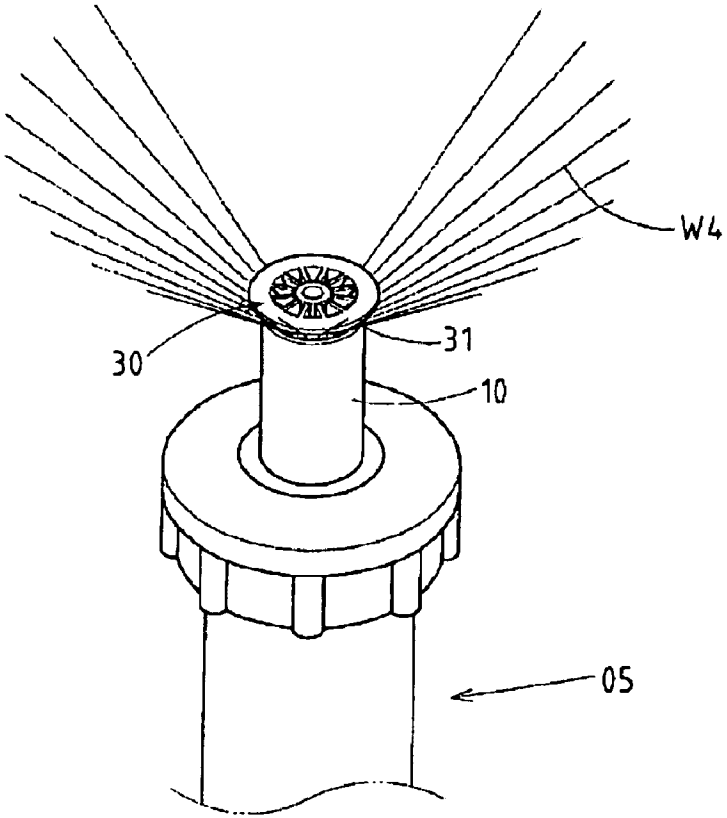
FIG. 11 shows a schematic view of a 270-degree spray pattern which is attained as a result of the arrangement as shown in FIG. 10.
Figure 10:
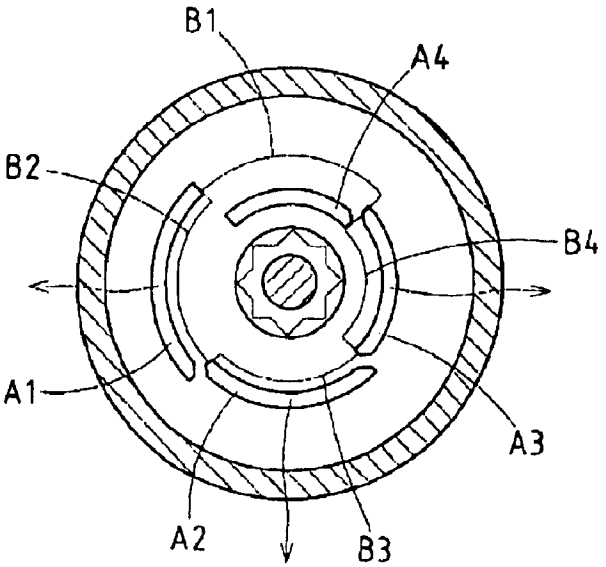
FIG. 10 shows a sectional schematic view of an arrangement of the arcuate rims and the arcuate through holes in the wake of a 270-degree rotation of the adjustment member of the present invention.

When the adjustment member 30 is turned an angle of 270 degrees, as illustrated in FIGS. 10 and 11, the fourth arcuate through hole A4 of the circular distribution member 20 is blocked by the first arcuate rim B1 of the control member 40, as shown in FIG. 10. In another words, the passage of water is allowed by the first arcuate through hole A1, the second arcuate through hole A2, and the third arcuate through hole A3. As a result of the 270-degree rotation of the adjustment member 30, a 270-degree spray pattern W4 is formed.

The embodiment of the present invention described above is to be regarded in all respects as being illustrative and nonrestrictive. Accordingly, the present invention may be embodied in other specific forms without deviating from the spirit thereof. The present invention is therefore to be limited only by the scope of the following claim.

I claim:

1. A lawn sprinkler comprising:

a connection pipe connected at a bottom end to a water source; and a spray angle adjustment structure mounted at a top end of said connection pipe for sprinkling water in various patterns;

wherein said spray angle adjustment structure comprises:

a circular distribution member provided with a center through hole and a series of arcuate through holes which are concentric and are progressively different in distance from a center of said center through hole whereby said circular distribution member is fixedly mounted in the top end of the connection pipe;

an adjustment member having a tapered portion and a projection extending from said tapered portion whereby said adjustment member is mounted on said circular distribution member in such a manner that said projection of said adjustment member is received in said center through hole of said circular distribution member; and a control member provided with a center hole, and a series of arcuate rims corresponding to said arcuate through holes of said circular distribution member whereby said control member is mounted beneath said circular distribution member such that said control member is fastened with said adjustment member by a fastening bolt which is engaged with a fastening hole of said projection of said adjustment member via said center hole of said control member and said center through hole of said circular distribution member, said control member being actuated to turn by said adjustment member in motion, thereby resulting in obstruction of one or more of said arcuate through holes of said circular distribution member by one or more of said arcuate rims of said control member so as to bring about the sprinkling of water in various patterns by said spray angle adjustment structure.

* * * * *